United States Patent [19]

Wilson

[11] 4,416,152

[45] Nov. 22, 1983

[54] FORMATION FLUID TESTING AND SAMPLING APPARATUS

[75] Inventor: Herbert C. Wilson, Houston, Tex.

[73] Assignee: Dresser Industries, Inc., Dallas, Tex.

[21] Appl. No.: 310,249

[22] Filed: Oct. 9, 1981

[51] Int. Cl.[3] ..... E21B 47/00; E21B 43/00

[52] U.S. Cl. ..... 73/155; 166/100

[58] Field of Search ..... 73/155, 151; 166/100

[56] References Cited

U.S. PATENT DOCUMENTS

| | | | |
|---|---|---|---|
| 2,674,313 | 4/1954 | Chambers | 166/1 |
| 3,011,554 | 12/1961 | Desbrandes et al. | 166/100 |
| 3,352,361 | 11/1967 | Urbanosky | 166/100 |
| 3,530,933 | 9/1970 | Whitten | 166/100 |
| 3,653,436 | 4/1972 | Anderson et al. | 166/100 |
| 3,811,321 | 5/1974 | Urbanosky | 73/155 |
| 3,813,936 | 6/1974 | Urbanosky et al. | 73/155 |
| 3,864,970 | 2/1975 | Bell | 73/155 |
| 3,934,468 | 1/1976 | Brieger | 73/155 |
| 3,952,588 | 4/1976 | Whitten | 73/155 |
| 4,248,081 | 2/1981 | Hallmark | 73/151 |
| 4,339,948 | 7/1982 | Hallmark | 73/155 |

*Primary Examiner*—Howard A. Birmiel

*Attorney, Agent, or Firm*—Richard M. Byron; Patrick H. McCollum

[57] ABSTRACT

Apparatus is provided for collecting a plurality of samples of fluids in earth formations traversed by a well bore. The sampling apparatus includes an elongated body member adapted to carry a telescopically extensible and retractible fluid admitting probe which is selectively placed in sealing engagement with potentially producible earth formations. The fluid admitting probe has a central passage in fluid communication with a first fluid sample chamber and a plurality of outer passages which are selectively communicated with formation fluid sample storage chambers within the body member.

16 Claims, 6 Drawing Figures

TO FIG. 2B

FORMATION FLUID TESTING AND SAMPLING APPARATUS

BACKGROUND OF THE INVENTION

This invention relates to fluid samplers, and more particularly to apparatus for performing non-destructive collection of fluid samples from subsurface earth formations traversed by a borehole.

The sampling of fluids contained in subsurface earth formations provide a method of testing formation zones of possible interest by recovering a sample of any formation fluids present for later analysis at the earth's surface while causing a minimum of damage to the tested formations. Thus, the formation sampler is essentially a point test of the possible producibility of subsurface formations. Additionally, a continuous record of the sequence of events during the test is made at the surface. From this record valuable formation pressure and permeability data can be obtained for formation reservoir analysis.

Early formation fluid sampling instruments were not fully successful as a commercial service because they were limited to a single test on each trip into the borehole. Later instruments were suitable for multiple testing, however, the success of these testers depended to some extent on the characteristics of the particular formations to be tested. For example, where earth formations were unconsolidated a different sampling apparatus was required than in the case of consolidated formations.

One of the major problems which has hampered the reliable testing of unconsolidated formations has been in designing a suitable system for establishing fluid communication with the formations. This problem is particularly accute in low pressure, low permeability, unconsolidated formations. For various reasons, systems designed for testing these formations have proven to be less than completely reliable. For example, U.S. Pat. No. 3,352,361, issued to Urbanosky, discloses of formation tester instrument including a tubular probe member having a tubular filter therein to capture formation particles entering the probe. U.S. Pat. No. 3,653,436, issued to Anderson et al, likewise has a filtering member, comprised of finely meshed screen within the tubular sampling probe. Usage has shown that in the aforementioned unconsolidated formation these filter members will become plugged, preventing formation fluids from passing therethrough and limiting reliable sampling to a single test.

U.S. Pat. No. 3,864,970, issued to Bell, attempts to overcome the problem of filter plugging by using two selectively sized filter passages, one size to pass plugging materials and the second sized to be smaller than the formation materials. Another technique can be found in U.S. Pat. No. 3,934,468, issued to Brieger, which utilizes a extendable filter probe which extends only when testing unconsolidated formations. Yet another technique is found in U.S. Pat. No. 4,248,081, issued to Hallmark, which uses a spiral spring within the tubular sampling probe as a filter member. The length of the spiral spring, and thus the filtering ability, is charged as the tubular sampling probe extends into the earth formations. While these advanced filter methods have provided some improvement in obtaining fluid samples in unconsolidated formations, they have not reliably prevented filter plugging where the unconsolidated formations are low pressure and low permeability.

Other efforts to increase reliability in obtaining samples of formation fluids in subsurface earth formations have encompassed various methods of cleaning the filter material. For example, U.S. Pat. No. 3,811,321, issued to Urbanosky, uses a selectively operable valve which is rapidly opened to place a low-pressure chamber and a flow line in the tool into communication with the isolated formation to remove plugging materials from a filtering median. U.S. Pat. No. 3,813,936, issued to Urbanosky et al, further attempts to clean the filter by taking in well fluids and discharging these fluids through the filter in reverse direction, into the earth formation for cleaning the filter before sampling. Yet another attempt to overcome the problem of filter plugging is illustrated in U.S. Pat. No. 3,952,588, issued to Whitten, which uses a selectively movable chamber to draw mud cake and other plugging materials into the chamber. Thereafter, the chamber is shifted to communicate with a screened entry port of the fluid admitting probe. While these advanced designs represent improvements, usage has shown that clayistic materials found in these problem earth formations are difficult to purge from a filtering member hampering the ability to consistantly obtain fluid samples in such formations.

Accordingly, the present invention overcomes the deficiencies of the prior art by providing method and apparatus for obtaining a plurality of formation fluid samples under adverse formation conditions in a single traversal of the borehole.

SUMMARY OF THE INVENTION

Apparatus for obtaining a plurality of formation fluid samples according to the present invention includes a new and improved fluid admitting member adapted for establishing fluid communication between earth formations and a fluid sampling and measuring instrument. The fluid admitting member is telescopically extensible from the instrument into sealing engagement with a potentially producible earth formation. A central tubular member coaxially disposed within a sealing member extends penetrating any mud cakes and extending into the earth formations. When the fluid admitting member is fully extended a pre-test sample is taken through a centrally located bore in the fluid admitting member. The pre-testing operation serves to pull any mud cakes and earth particles further into the central bore exposing to any formation fluids present a plurality of coaxially located passages within the fluid admitting member. Any formation fluids present are then collected through the coaxial passages connecting to sample storage chambers within the body of the instrument. Upon completion of the sampling operation the pre-test sample is expelled through the central bore dislodging any mud cakes or earth formation particles contained in the central bore.

DETAILED DESCRIPTION OF THE PREFERRED EMBODIMENT

Figure 1:
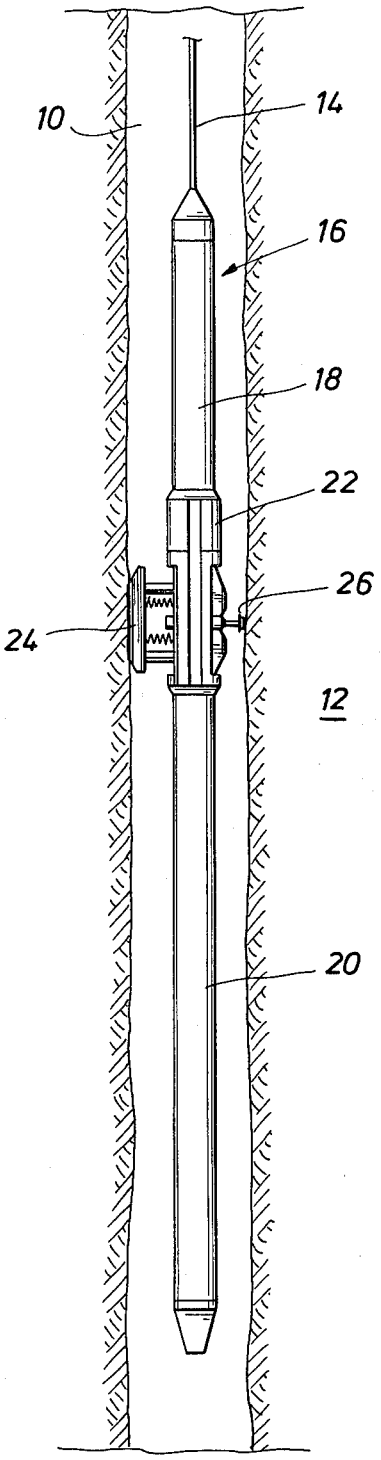
FIG. 1 is a pictorial view, partly in cross-section, of a formation testing instrument disposed in a borehole.

Referring now to the drawings in more detail, especially to FIG. 1, there is illustrated schematically a section of a borehole 10 penetrating a portion of the earth formations 12, shown in vertical section. Disposed within the borehole 10 by means of a cable or wireline 14 is a sampling and measuring instrument 16. The sample and measuring instrument 16 is comprised of a hydraulic power system section 18, a fluid sample storage section 20, and a sampling mechanism section 22. Sample mechanism section 22 includes selectively extensible well engaging pad member 24 and a selectively extensible fluid admitting member 26.

In operation sampling and measuring instrument 16 is positioned within borehole 10 by means of cable 14 being wound on or unwound from a drum (not shown) located at the earth's surface. When sampling and measuring instrument 16 is disposed adjacent an earth formation of interest electrical control signals are transmitted through electrical conductors contained within cable 14 from a surface electronic assembly (not shown) to sampling and measuring instrument 16. These electrical control signals activate the hydraulic power system section 18 causing the well engaging pad member 24 and the fluid admitting member 26 to move laterally from sampling and measuring instrument 16 into engagement with the earth formations 12. Fluid admitting member 26 is placed in fluid communication with the earth formation 12 allowing for the taking of a sample of any producible connate fluids contained in the earth formations.

Figure 2A:
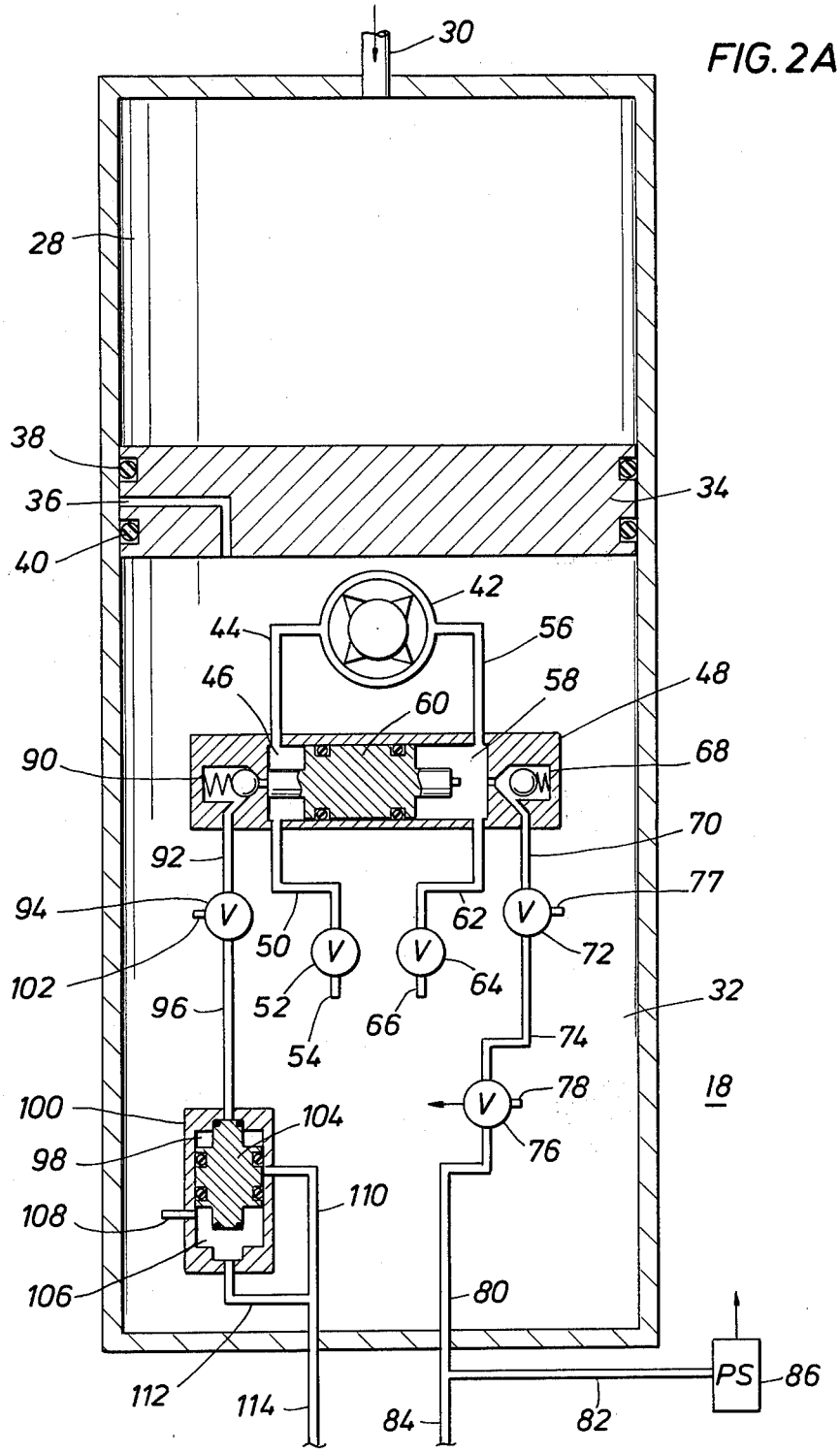
FIGS. 2A–2C together show a somewhat-schematic representation of the formation testing instrument illustrated in FIG. 1.
Figure 2B:
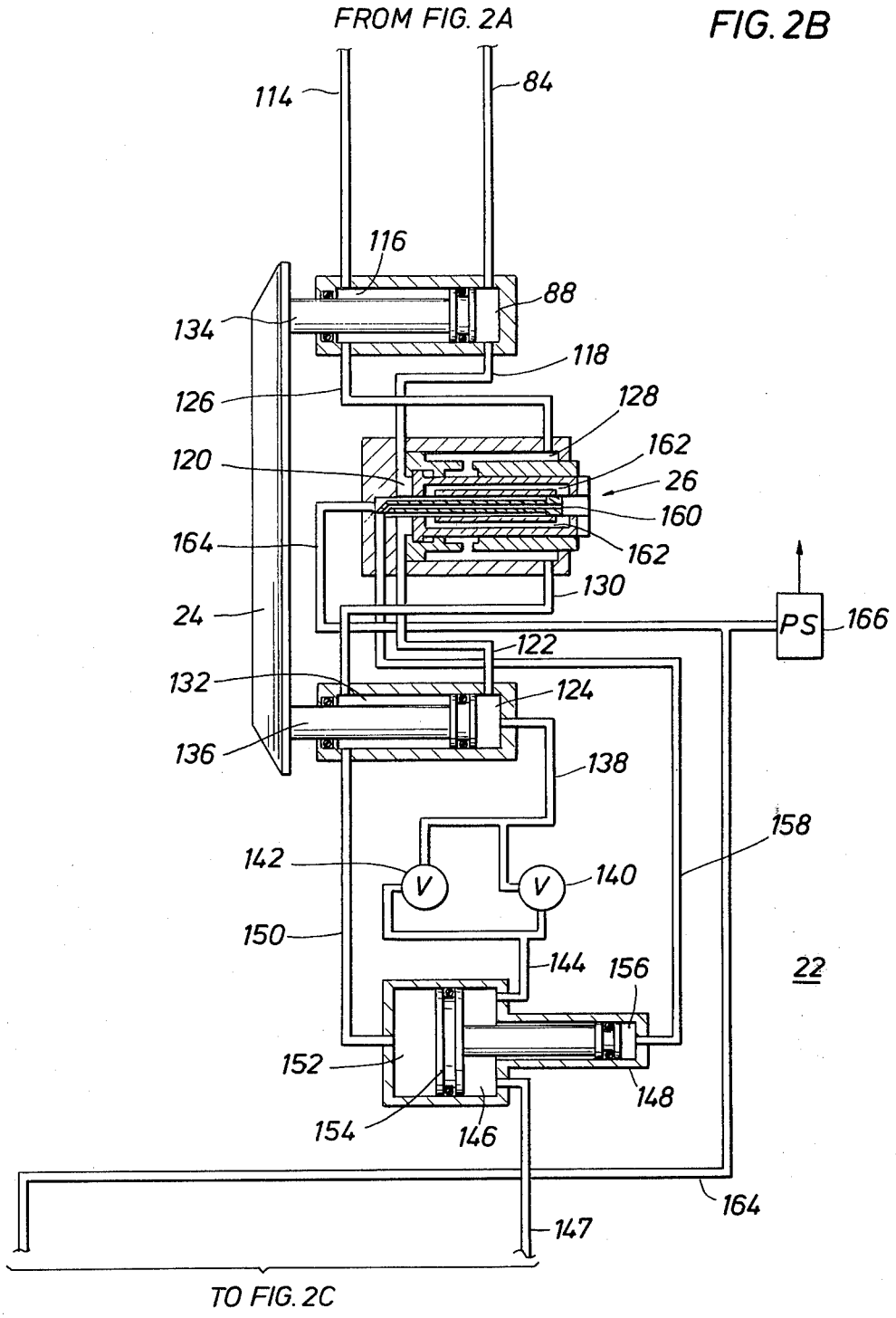
Figure 2C:
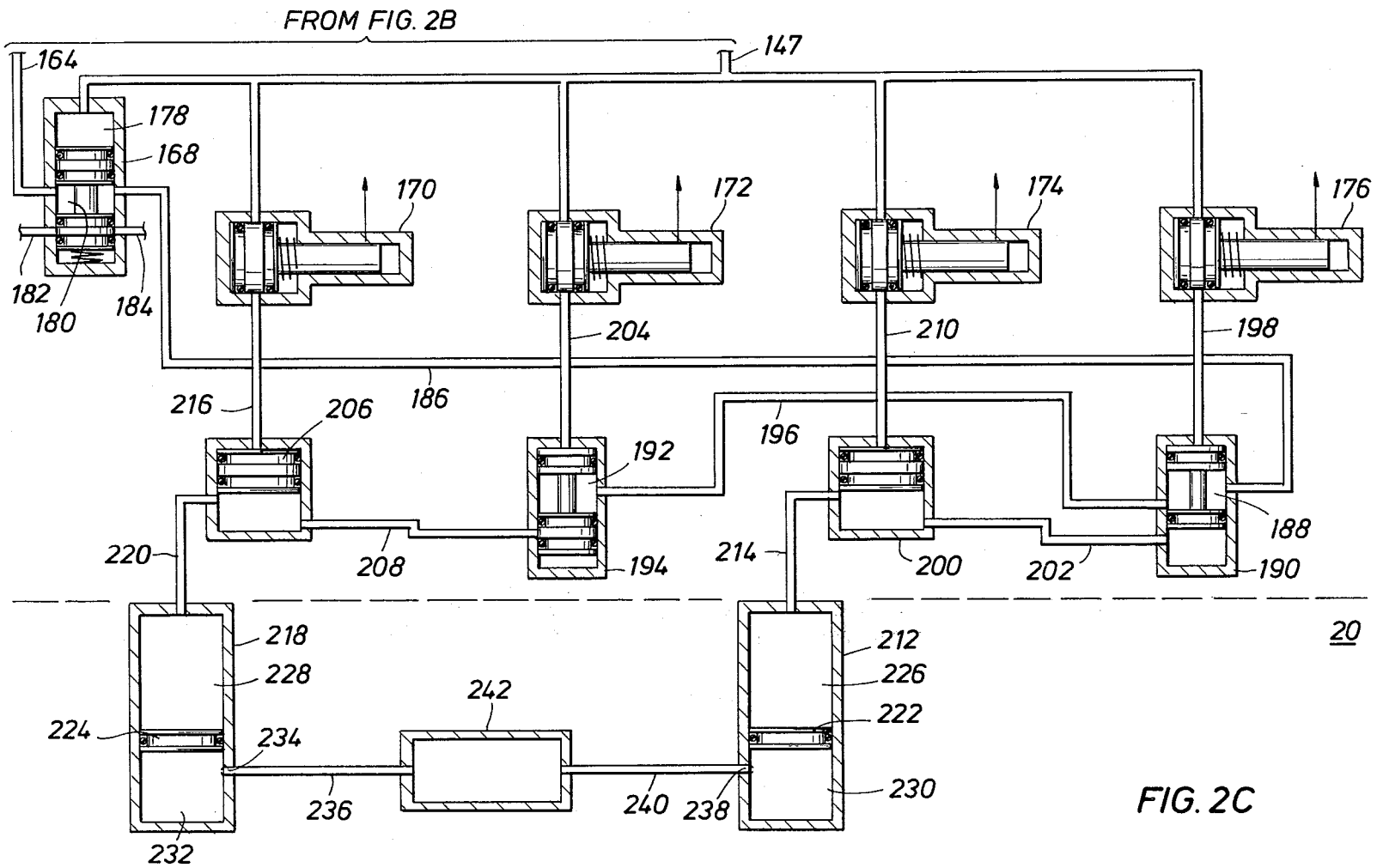

Referring now to FIGS. 2A through 2C, there is illustrated a somewhat-schematic representation of the hydraulic power system section 18, the sampling mechanism section 22 and the fluid sample storage section 20 of sampling and measuring instrument 16. The hydraulic power system section 18 includes an upper borehole fluid chamber 28, which is in fluid communication with the borehole through passage 30, and a lower hydraulic fluid chamber 32, which contains a hydraulic fluid such as oil or the like. Disposed between the upper borehole fluid chamber 28 and the lower hydraulic fluid chamber 32 is a free-floating isolation piston 34. Isolation piston 34 serves to not only isolate the upper borehole fluid chamber 28 from the lower hydraulic fluid chamber 32 but also maintains the hydraulic fluid within the hydraulic fluid chamber 32 at a pressure about equal to the hydrostatic pressure at whatever depth the tool is situated in the borehole, as well as for accommodating for volumetric changes in the hydraulic fluid which may occur under various borehole conditions. A passage 36 is provided within piston 34 from hydraulic fluid reservoir 32 to the outside pheriphery of isolation piston 34 between o-rings 38 and 40 to prevent pressure locking of the isolation piston 34.

Since sampling and measuring instrument 16 is to be operated at great depths within boreholes which can contain dirty and unusually corrosive fluids, housed within the protection of the hydraulic fluid chamber 32 is an electrically powered reversible hydraulic pump 42. Hydraulic pump 42 has a first hydraulic line or conduit 44 connecting to fluid chamber 46 within slide valve assembly 48. Hydraulic line 50 connects fluid chamber 46 with check valve 52 which further communicates with lower hydraulic fluid chamber 32 by hydraulic line 54. A second hydraulic line 56 connects hydraulic pump 42 with fluid chamber 58 located on the opposite side of slide valve 60 of slide valve assembly 48. Hydraulic line 62 connects fluid chamber 58 with check valve 64 which communicates with hydraulic fluid chamber 32 by hydraulic line 66.

Fluid chamber 58 of slide valve assembly 48 connects through check valve 68 to hydraulic line 70 connecting to pressure regulating valve 72. Pressure regulating valve 72 has a first hydraulic line 74 connecting to electrically controllable dump valve 76, and a second hydraulic line 77 communicating with hydraulic fluid chamber 32. Dump valve 76 communicates with hydraulic fluid chamber 32 through hydraulic line 78. A second hydraulic line 80 from dump valve 76 connects to branch hydraulic lines 82 and 84, which connect to hydraulic fluid pressure sensor 86 and well engaging member piston extender chamber 88, respectively.

Fluid chamber 46 of slide valve assembly 48 connects through check valve 90 to hydraulic line 92 connecting to pressure regulating valve 94. Pressure regulating valve 94 has a first hydraulic line 96 connecting to fluid chamber 98 within shuttle valve assembly 100, and a second hydraulic line 102 communicating with hydraulic fluid chamber 32. Shuttle valve assembly 100 has a slide valve 104 disposed between fluid chamber 98 and fluid chamber 106. Hydraulic line 108 connects fluid chamber 106 with hydraulic fluid chamber 32. Branching hydraulic lines 110 and 112 connect fluid chambers 98 and 106, respectively, with hydraulic line 114 connecting to well engaging member piston retractor chamber 116.

Well engaging member piston extender chamber 88 is coupled through hydraulic line 118 to fluid admitting member extender chamber 120 which is further coupled through hydraulic line 122 to well engaging member piston extender chamber 124. Well engaging member piston retractor chamber 116 is coupled through hydraulic line 126 to fluid admitting member retractor chamber 128 which is further coupled through hydraulic line 130 to well engaging member piston retractor chamber 132. Well engaging pad member pistons 134 and 136 are a longitudinally spaced pair of laterally movable pistons arranged traversely on the body of sampling and measuring instrument 16. Pistons 134 and 136 are arranged to provide contemporaneous expansion of well engaging pad member 24 and fluid admitting member 26. Conversely, pistons 134 and 136 cooperate to provide contemporaneous retraction of well engaging pad member 24 and fluid admitting member 26.

Piston extender chamber 124 couples to hydraulic line 138 which branchingly couples to relief valve 140 and check valve 142. Relief valve 140 and check valve 142 are coupled through hydraulic line 144 to fluid chamber 146 within pre-test sample assembly 148. Fluid chamber 146 is branchingly coupled through hydraulic line 147 to fluid chamber 178 of equalizer valve 168, solenoid valve 170, solenoid valve 172, solenoid valve 174 and solenoid valve 176. Solenoid valves 170, 172, 174 and 176 can be any suitable electrically controllable hydraulic control valves, such as those sold by ATKOMATIC VALVE COMPANY, under part number 15-885. These valves are controlled by an electrical command and switching system known in the art, such as the system described in U.S. Pat. No. 3,780,575 which is incorporated herein by reference.

Piston retractor chamber 132 is coupled through hydraulic line 150 to fluid chamber 152 within pre-test sample assembly 148. Fluid chamber 146 and fluid chamber 152 are fluidly isolated from one another by displacement piston 154. Pre-test sample assembly 148 includes an expansible pre-test fluid sample chamber 156 coupled through fluid line 158 to a central bore 160 within fluid admitting member 26. Fluid admitting member 26 will be more fully described later herein. In the preferred embodiment, pre-test fluid sample chamber is designed to hold a relative small amount of formation fluids such as a volume from between 10 cc to 20 cc.

Fluid admitting member 26 is provided with second coaxial fluid passages 162 connecting to fluid line 164 which branchingly connects to formation pressure sensor 166, and fluid chamber 180 within equalizer valve 168. Additionally, equalizer valve 168 can be placed in fluid communication with the borehole by conduits 182 and 184. Fluid chamber 180 of equalizer valve 168 couples through fluid line 186 to fluid chamber 188 within first sample storage tank control valve 190. Fluid chamber 188 further connects to fluid chamber 192 within second sample storage tank control valve 194 by fluid line 196. First sample storage tank control valve 190 connects to solenoid valve 176 by hydraulic line 198 and connects to first sample storage tank lock valve 200 by fluid line 202. Second sample storage tank control valve 194 connects to solenoid valve 172 by hydraulic line 204 and connects to second sample storage tank lock valve 206 by hydraulic line 208. First sample storage tank lock valve 200 couples to solenoid valve 174 by hydraulic line 210 and couples to the first sample storage tank 212 by fluid line 214. Second sample storage tank lock valve 206 couples to solenoid valve 170 by hydraulic line 216 and couples to the second sample storage tank 218 by fluid line 220.

Sample storage tanks 212 and 218 are divided into two separate fluid cavities by floating pistons 222 and 224, respectively. The upper chamber of tank 212 comprises a fluid sample storage chamber 226 with the upper chamber of tank 218 forming a second fluid sample storage chamber 228. Lower chamber 230 of tank 212 and the lower chamber 232 of tank 218 comprise water reservoirs. Water reservoirs 232 and 230 are respectively coupled through flow control orifice 234 and water line 236, and flow control orifice 238 and water line 240 to water cushion storage tank 242.

In the operating of the sampling and measuring instrument of FIG. 2, instrument 16 is positioned within a borehole opposite earth formations to be tested. Borehole mud and fluids enter borehole fluid chamber 28 by passage 30 which communicates with the borehole 10. The weight of the borehole fluid column is exerted as hydrostatic pressure within borehole fluid chamber 28, with this hydrostatic pressure acting on isolation piston 34 to produce counterbalancing pressure in the hydraulic fluid of the power system. As the sampling and measuring instrument 16 is lowered into the borehole, the hydrostatic pressure increases and forces isolation piston 34 to move downward towards sampling mechanism section 22. The movement compresses the volume of the hydraulic fluid chamber 32, causing a corresponding increase in fluid pressure throughout the hydraulic system. Isolation piston 34 movement stops when the hydraulic system fluid pressure reaches a value approximately equaling the hydrostatic pressure. To prevent pressure locking of isolation piston 34, passage 36 supplies hydraulic fluid from hydraulic fluid reservoir 32 to the outside pheriphery of isolation piston 34, between o-ring seals 38 and 40.

When sampling and measuring instrument 16 is positioned within a borehole at a desired sampling location, motor driven hydraulic pump 42 and a spring-loaded dump valve 76 receive energizing voltages from an electrical command unit (not shown). These command signals set the hydraulic pump in the pump forward (PF) position and maintain dump valve 76 in a de-energized position. The rotation of hydraulic pump 42 draws hydraulic fluid from hydraulic fluid reservoir 32 through hydraulic line 54, check valve 52 and hydraulic line 50 into fluid chamber 46 of slide valve assembly 48. The hydraulic fluid is then drawn through hydraulic line 44 into hydraulic pump 42 being further pumped through hydraulic line 56 into fluid chamber 58 of slide valve assembly 48 where the hydraulic fluid moves slide valve 60 to block the passage to check valve 90, unseating check valve 68 at the entrance to hydraulic line 70 coupled to pressure regulating valve 72. Pressure regulating valve 72 allows a hydraulic fluid pressure flow to peak from preferably between 1700 psi and 1750 psi before unseating and opening a return path through hydraulic line 77 to hydraulic fluid chamber 32.

The PF hydraulic fluid flow travels through hydraulic line 74, through dump valve 76 and hydraulic lines 80 and 82 to hydraulic fluid pressure sensor 86. Hydraulic fluid pressure sensor 86 is a Bourdon pressure gage which converts the hydraulic fluid pressure into an electrical signal which is transmitted to the surface electronic section (not shown). Additionally, the PF hydraulic fluid flow moves through hydraulic line 84 into piston extender chamber 88, further passing through hydraulic line 118 into fluid admitting member extender chamber 120, continuing through hydraulic line 122 into piston extender chamber 124. The output signal from hydraulic fluid pressure sensor 86 increases as the hydraulic fluid pressure surge forces pistons 134 and 136 to move well engaging pad member 24 laterally in relation to the longitudinal axis of the borehole into contact with the well of the borehole.

Contemporaneous with the lateral extension of well engaging pad member 24, the PF hydraulic fluid pressure within fluid admitting member extender chamber 120 extends the components of the fluid admitting member 26 in a telescoping manner forcing the leading portion of fluid admitting member through any mud cakes present and into fluid communication with the earth formations. As previously stated, fluid admitting member 26 will be described in greater detail later herein. When the PF hydraulic fluid flow pressure reaches a predetermined value, such as, for example, 1200 psi, relief valve 140 unseats, passing hydraulic fluid flow pressure through hydraulic line 144 into fluid chamber 146 of pre-test sample assembly 148, moving displacement piston 154 rearward within pre-test sample assembly 148. The rearward movement of displacement piston 154 causes any mud cakes and formation particles in central bore 160 of fluid admitting member 26 to be pulled rearwardly within central bore 160 and causes a relatively small formation fluid to be pulled through fluid line 158 into pre-test fluid sample chamber 156. The predetermined pressure threshold which unseats relief valve 140 is selected to be of a threshold to assure that before formation fluids are taken into formation admitting member 26 for pre-test that both well engaging pad member 24 and fluid admitting member 26 are fully extended to and establish firm contact with the wall of the borehole, and that the leading portion of fluid admitting member 26 penetrates through any mud cakes on the wall of the borehole.

As previously stated, the rearward movement of displacement piston 154 within pre-test sample assembly 148 pulls any mud cakes and formation particles lodged within central bore 160 rearwardly within central bore 160. The rearwardly movement of mud cakes and formation particles within central bore 160 opens a number of forwardly located lateral fluid passages connecting central bore 160 to a number of coaxial fluid passages 162, placing passages 162 into fluid communication through fluid line 164 to formation pressure sensor 166 and equalizer valve 168. Formation pressure sensor 166 is a strain gage functioning as an electrical resistance bridge. Formation fluid pressures alter the electrical resistance, imbalancing the electrical bridge producing an output voltage signal representative of the formation pressures. The formation pressure sensor 166 output signal is transmitted to the surface control unit. The signal will indicate an initial pressure drop as fluids intake into pre-test sample assembly 148 with a subsequent increase and leveling off to a constant valve if producible connate fluids are present within the pre-tested earth formations.

The unseating of relief valve 140 allowing hydraulic fluid flow into fluid chamber 146 of pre-test sample assembly 148 further allows hydraulic fluid flow through branch hydraulic line 147 to fluid chamber 178 of equalizer valve 168, solenoid valve 170, solenoid valve 172, solenoid valve 174 and solenoid valve 176. The PF hydraulic fluid pressure flow into fluid chamber 178 of equalizer valve 168 moves the valve piston thereby allowing passage of any formation fluids present in fluid line 164 into fluid line 186 and further into fluid chamber 188 of first sample storage tank control valve 190 and through fluid line 196 into fluid chamber 192 of second sample storage tank control valve 194.

To collect a formation sample, an electrical command signal is transmitted to solenoid valve 176 which shifts the valve piston within solenoid valve 176 opening a PF hydraulic fluid path through hydraulic line 198 to first sample storage tank control valve 190 shifting the piston in this valve, allowing formation fluids to pass through fluid line 202, through first sample storage tank lock valve 200, which is a normally open lock valve, through fluid line 214 and into fluid sample storage chamber 226 of first sample storage tank 212. When a suitable sample has been accumulated in sample storage chamber 226 an electrical command signal is transmitted to solenoid valve 174 opening a PF hydraulic fluid path through hydraulic line 210 to first sample storage tank lock valve 200 shifting the valve piston blocking the fluid path to first sample storage tank 212, with the collected fluid sample retained therein. In a similar manner, a fluid sample is collected and retained within second sample storage tank 218 by electrical command signals to solenoid valves 172 and 170.

Formation fluids entering fluid sample storage chamber 226 or fluid sample storage chamber 228 at their formation zone pressures moves the respective floating piston 222 or 224 toward the bottom of first sample storage tank 212 or second sample storage tank 218, respectively. The downward movement of floating piston 222 or 224 displaces fluid, such as water, contained within the appropriate water reservoir 230 or 232. Water is returned to water cushion tank 242 through flow control orifice 238 or 234 at a steady, predictable rate established by the size of the orifice. A more complete description of the water cushion system can be found in the aforementioned U.S. Pat. No. 3,011,554, which has been incorporated herein by reference.

When it has been determined by the pre-test that the earth formations are unsuited for testing or when a formation sample has been obtained electrical command signals are transmitted to dump valve 76 and motor driven hydraulic pump 42, opening dump valve 76 through hydraulic line 78 into hydraulic fluid chamber 32 and reversing the rotation hydraulic pump 42. The resulting rotation of hydraulic pump 42 provides pump reverse pressure flow (PR). Hydraulic pump 42 draws fluid from hydraulic fluid chamber 32 through hydraulic line 66, check valve 64 and hydraulic line 62 into fluid chamber 58 of slide valve assembly 48. Hydraulic fluid is further drawn through hydraulic line 56 into hydraulic pump 42 further being pumped through hydraulic line 44 into fluid chamber 46 of slide valve assembly 48, moving slide valve 60 to block check valve 68 opening a passage to check valve 90. The pressurized hydraulic fluid unseats check valve 90 entering hydraulic line 92 and flowing into pressure regulating valve 94. Pressure regulating valve 94 allows the PR flow pressure to peak preferably between 1700 and 1750 psi before unseating and opening a return line through hydraulic line 102 into hydraulic fluid chamber 32.

The PR hydraulic fluid flow passes from pressure regulating valve 94 through hydraulic line 96 into fluid chamber 98 of shuttle valve assembly 100 moving slide valve 104 to block hydraulic lines 108 and 112 and opening a fluid path through hydraulic lines 110 and 114 into piston retractor chamber 116. From piston retractor chamber 116 hydraulic fluid pressure passes through hydraulic line 126 into fluid admitting member retractor chamber 128 further passing through hydraulic line 130 into piston retractor chamber 132. The PR hydraulic flow moves pistons 134 and 136 rearwardly retracting well engaging pad member 24 from contact with the borehole wall. On the opposite side of the sampling and measuring instrument 16 the PR hydraulic pressure flow telescopically retracts fluid admitting member 26. Moving from piston retractor chamber 132 through hydraulic line 150 hydraulic fluid flows into fluid chamber 152 of pre-test sample assembly 148 pushing displacement piston 154 forward. This movement of displacement piston 154 forces formation fluids within fluid chamber 156 through fluid line 158 and central bore 160 of fluid admitting member 26, forcing any mud cakes and formation particles in central bore 160 to be displaced and pushed into the borehole. Hydraulic fluid from fluid chamber 146 is displaced through check valve 142 into the PF hydraulic line system back into hydraulic fluid chamber 32.

Additionally, when the hydraulic pump 42 rotates to create PR hydraulic fluid flow spring-loaded piston of equalizer valve 168 closes the fluid flow path from fluid line 164 fluid line 186 blocking fluid passage to first and second sample storage tanks control valves 190 and 194. In this valve position a borehole fluid path is provided through fluid lines 182 and 184 into fluid line 164 and coaxial fluid passage 162 returning to the borehole. The pressure of the borehole fluid flow counteracts the pressure exerted externally on fluid admitting member 26 by the borehole fluids and aids the PR pressure flow in restracting fluid admitting member 26. The borehole fluid flow also serves to clean any formation particles from coaxial fluid passage 162.

Figure 3:
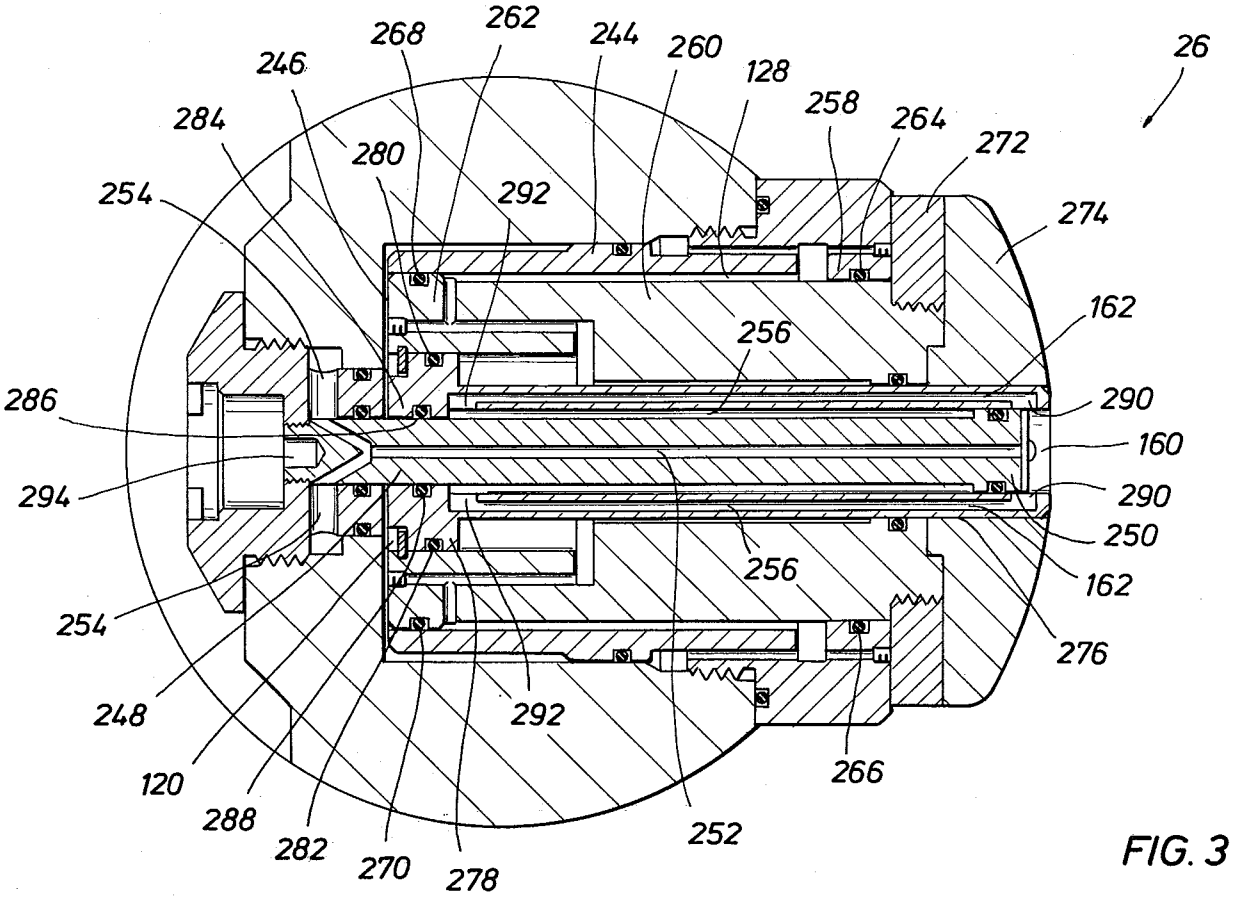
FIG. 3 illustrates the fluid admitting member of the present invention appearing in a fully-retracted position.

Referring now to FIG. 3, there is illustrated in a fully retracted position fluid admitting member 26. As shown, fluid admitting member 26 includes an outer tubular member 244 having a traverse wall 246 closing the rear end. Centrally disposed within outer tubular member 244 and extending rearwardly through traverse wall 246 is tubular member 248. Tubular member 248 has an enlarged diameter forward end portion 250 and an axial bore 252 therethrough connected to a pair of lateral parts 254. Outer tubular member 244 has a reduced diameter forward end portion 258.

Coaxially disposed within outer tubular member 244 is intermediate tubular member 260. Intermediate tubular member 260 has an enlarged diameter rear end portion 262. Fluid admitting member retractor chamber 128 is formed between the inner wall of outer tubular member 244 and the outer wall of intermediate tubular member 260 by means of fluid sealing members, such as o-rings 264, 266, 268 and 270. Support plate 272 is mounted on the forward end of intermediate tubular member 260. Mounted on the forward face of support plate 272 is an elastomeric annular sealing pad 274. Coaxially disposed within and extending rearwardly from sealing pad 274 is a second intermediate tubular member 276. Inner tubular member 276 is slidably mounted within intermediate tubular member 260 and is slidably mounted on tubular member 248. Inner tubular member 276 has an enlarged diameter rear portion 278 with sealing members 280 and 282 located therein. Also, inner tubular member 276 has a reduced diameter rear portion 284 with sealing members 286 and 288 located therein. Fluid admitting member extender chamber 120 is thus formed within fluid admitting member 26. Inner tubular member 276 has a number of forwardly located lateral passages from central bore 160, illustrated at 290, connecting to a corresponding number of coaxial passages, illustrated at 162, traversing longitudinally through inner tubular member 276, connecting to rearwardly located lateral passages 292.

Figure 4:
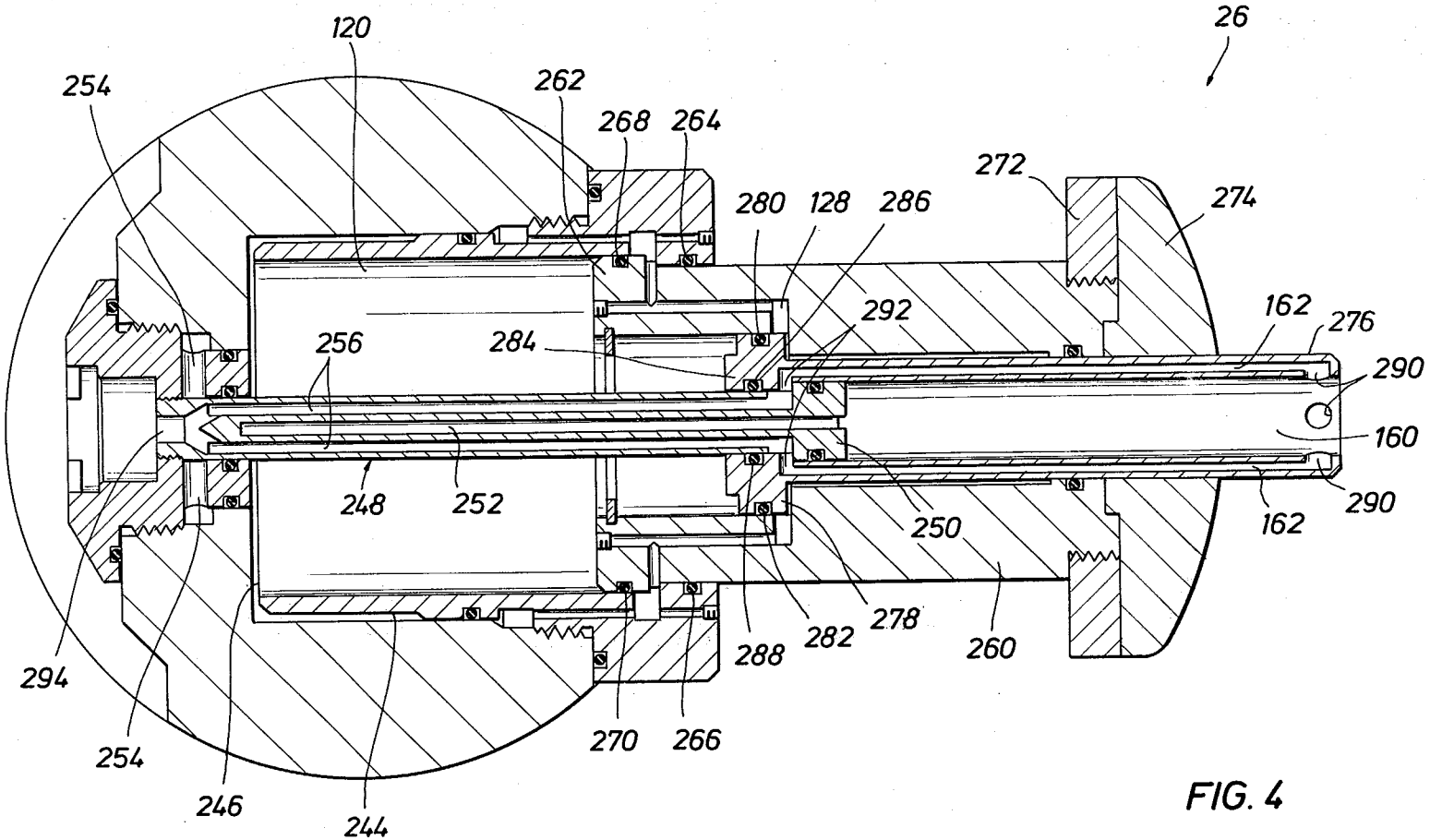
FIG. 4 is a view similar to FIG. 3 but depicts the fluid admitting member of the present invention in a fully-extended position.

Turning now to FIG. 4, there is illustrated in the fully extended position fluid admitting member 26. The reference numbers used in FIG. 4 correspond to the reference numbers used for like elements in FIG. 3. As previously described, to extend fluid admitting member 26 hydraulic fluid is pumped into fluid admitting member extender chamber 120 causing first intermediate tubular member 260 and second intermediate tubular member 276 to telescopically extend from outer tubular member 244. As tubular member 260 and 276 cooperatively extend, sealing pad 274 contacts a portion of the borehole wall isolating inner tubular member 276 and central bore 160 from borehole fluids. Inner tubular member 276 further extends through sealing pad 274 penetrating any mud cakes located on the borehole wall and further penetrating the earth formations. When intermediate tubular member 260 and inner tubular member 276 are fully extended there are provided two formation fluid paths within fluid admitting member 26. Central bore 160 is in fluid communication with axial bore 252 which communicates through lateral ports 254 through fluid line 158 to pretest sample assembly 148 of FIG. 2. Also, central bore 160 is in fluid communication through lateral ports 290 with coaxial fluid passages 162, through lateral ports 292 to coaxial fluid passages 256, to rearwardly exiting fluid passage 294 which connects to fluid line 164 of FIG. 2.

In operation, when inner tubular member 276 fully extends through any mud cakes and into the earth formations, these mud cakes and particles of the earth formations will be disposed within the forward end of central bore 160. In a manner previously described, when a pre-test sample is pulled into pre-test assembly 148 these mud cakes and earth particles will be pulled rearwardly within central bore 160 exposing lateral ports 290 to formation fluids. These formation fluids can then flow through coaxial bores 162, lateral ports 292, coaxial passage 256, and rear passage 294 into formation fluid line 164 of FIG. 2, for measuring and collecting. When formation sample collecting is complete, hydraulic fluid is pumped into fluid admitting member retractor chamber 128 causing inner tubular member 276 and intermediate tubular member 260 to be retracted into outer tubular member 244. Simultaneously, the pre-test sample within pre-test sample assembly 248 is expelled through lateral passages 254, axial bore 252 and central bore 160 receiving any mud cakes and formation particles from central bore 160 back into the borehole.

Many modifications and variations besides those specifically illustrated may be made in the techniques and structures described herein without departing substantially from the concept of the present invention. Accordingly, it should be understood that the forms of the invention described and illustrated herein are exemplary only, and are not intended as limitations on the scope of the present invention.

The embodiments of the invention in which an exclusive property or privilege is claimed are defined as follows:

1. Fluid sampling apparatus for obtaining samples of connate fluids from subsurface earth formations traversed by a borehole comprising:

a body member adapted for suspension in a borehole;

first fluid sample collecting means cooperatively arranged on said body member for receiving a first sample of connate fluids;

second fluid sample collecting means cooperatively arranged on said body member for receiving a second sample of connate fluids;

fluid sampling probe means cooperatively arranged on said body member, said probe means having a first fluid flow path comprising a central passage along the longitudinal axis of said probe and a second fluid flow path comprising a plurality of radially spaced longitudinal passages disposed about the longitudinal axis of said probe;

hydraulic fluid power means for telescopically extending said sampling probe means into fluid communication with an earth formation;

first fluid passage means including said first flow path within said sampling probe means providing an unrestricted fluid path between said earth formation and said first sample collecting means; and second fluid passage means including said second flow path within said sampling probe means providing an unrestricted fluid path between said earth formation and said second sample collecting means.

2. The fluid sampling apparatus of claim 1, wherein said first fluid sample collecting means comprises:

selectively expansible fluid sample storage means for retaining said first fluid sample; and pressure sensitive means for expanding said expansible storage means at a predetermined hydraulic fluid pressure generated by said hydraulic power means, said expansion causing said first sample to be pulled through said first fluid passage means into said storage means.

3. The fluid sampling apparatus of claim 1, wherein said second fluid sample collecting means comprises:

fluid sample storage means for retaining said second fluid sample;

first selectively operable control means for fluidly communicating said second fluid passage means with said fluid sample storage means; and second selectively operable control means for fluidly isolating said fluid sample storage means.

4. Apparatus for collecting samples of the fluid content of earth formations traversed by a borehole comprising:

an elongated body member adapted to traverse a borehole;

first sample collecting means cooperatively arranged on said body member for receiving a sample of said fluid content;

second sample collecting means cooperatively arranged on said body member for receiving a sample of said fluid content;

telescopically extensible and retractable sealing means having a central opening therein cooperatively arranged on said body member for engaging the wall of said borehole and isolating a portion thereof from well bore fluids; and a tubular probe having a forward opening therein and extensible through said central opening into said earth formations for establishing fluid communication therewith, said tubular probe having first and second passages therewith for fluidly connecting said forward opening and first and second sample collecting means, respectively, said first passage comprising a central bore along the longitudinal axis of said probe and said second passage comprising a plurality of radially spaced longitudinal passages disposed about the longitudinal axis of said probe.

5. The sample collection apparatus of claim 4, further including hydraulic fluid power means coupled to said sealing means and said tubular probe cooperatively arranged to selectively extend and retract said sealing means and said tubular probe.

6. The sample collecting apparatus of claim 5, wherein said first sample collecting means comprises:

fluid sample retaining means for retaining said fluid sample; and pressure sensitive means for activating said fluid sample storage means at a predetermined hydraulic fluid pressure, said activation causing a fluid sample to traverse through said first passage into said fluid sample storage means.

7. The sample collecting apparatus of claim 6, wherein said second sample collecting means comprises:

first fluid sample storage means for retaining said fluid sample;

first selectively operable valve means for fluidly connecting said second passages of said tubular probe and said first sample storage means; and second selectively operable valve means for fluidly sealing said first sample storage means.

8. The sample collecting apparatus of claim 7, further comprising pressure measuring means cooperatively arranged on said body member for providing electrical signals representative of the pressure of said formation fluid contents.

9. The sample collecting apparatus of claim 8, further comprising third sample collecting means cooperatively arranged on said body member for receiving a sample of said fluid content.

10. The sample collecting apparatus of claim 9, wherein said third sample collecting means comprises:

second fluid sample storage means for retaining said fluid sample;

third selectively operable valve means fluidly communicating said second sample storage means with said first valve means of said second sample collecting means; and fourth selectively operable valve means for fluidly sealing second sample storage means.

11. Fluid sampling apparatus for obtaining samples of connate fluids from subsurface earth formations traversed by a borehole comprising:

a body member adapted for suspension in a borehole;

first fluid sample collecting means cooperatively arranged on said body member for receiving a first sample of connate fluids;

second fluid sample collecting means cooperatively arranged on said body member for receiving a second sample of connate fluids;

fluid sampling probe means having cooperatively arranged on said body member said fluid sampling probe means comprising;

an outer tubular member cooperatively arranged on said body member;

an inner tubular member mounted centrally within said outer tubular member;

a first intermediate tubular member slidably retained within said outer tubular member;

annular sealing means cooperatively arranged on said first intermediate tubular member for isolating a portion of the wall of the borehole from the well bore fluids, said sealing means having a central opening therein; and a second intermediate tubular member slidably retained within said first intermediate tubular member and slidably mounted on said inner tubular member;

said first intermediate tubular member and said second intermediate tubular member being telescopically extensible and retractable within said outer tubular member for providing fluid communication with said earth formations;

hydraulic fluid power means for telescopically extending said sampling probe means into fluid communication with an earth formation;

first fluid passage means within said sampling probe means providing a fluid path between said earth formation and said first sample collecting means; and second fluid passage means within said sampling probe means providing fluid path between said earth formations and said second sample collecting means.

12. The fluid sampling apparatus of claim 11, wherein said first fluid passage means comprises a centrally located bore along the longitudinal axis of said inner tubular member and said second intermediate tubular member.

13. The fluid sampling apparatus of claim 12, wherein said second fluid passage means comprises a plurality of longitudinal bores surrounding the longitudinal axis of said inner tubular member and said second intermediate tubular member.

14. The fluid sampling apparatus of claim 13, further comprising pressure measuring means cooperatively arranged for said body member for providing electrical signals representative of the pressure of said connate fluids.

15. The fluid sampling apparatus of claim 14, further comprising pressure measuring means cooperatively arranged on said body member for providing electrical signals representative of the pressure of the hydraulic fluid of said hydraulic power means.

16. A fluid sampling probe, cooperatively arranged on a body member adapted to traverse a borehole penetrating earth formations, for fluidly communicating a portion of the earth formations with a first and a second fluid retaining chamber cooperatively arranged on a body member, said probe comprising:

an outer tubular member mounted on said body member;

an inner tubular member centrally mounted in said outer tubular member, said inner tubular member having a first central fluid passage traversing longitudinally therethrough and a plurality of second longitudinal fluid passages disposed around said first fluid passage traversing therethrough;

a first intermediate tubular member slidably retained within and expansible from said outer tubular member; and a second intermediate tubular member slidably retained within and expansible from said first intermediate tubular member and slidable retained on said inner tubular member, said second intermediate tubular member having a forward opening therein, a central fluid passage longitudinally therethrough for fluidly communicating with said inner tubular member central fluid passage, and a plurality of longitudinal fluid passages traversing therethrough fluidly communicating with said inner tubular member plurality of longitudinal fluid passages when said first intermediate and second intermediate tubular members fully extend from said outer tubular member.

* * * * *

UNITED STATES PATENT AND TRADEMARK OFFICE

CERTIFICATE OF CORRECTION

PATENT NO. : 4,416,152

DATED : November 22, 1983

INVENTOR(S) : Herbert C. Wilson

It is certified that error appears in the above—identified patent and that said Letters Patent is hereby corrected as shown below:

Claim 4, line 36, "therewith" should read "therethrough".

Signed and Sealed this

*Twenty-eighth* Day of *February 1984*

[SEAL]

*Attest:*

GERALD J. MOSSINGHOFF

*Attesting Officer*

*Commissioner of Patents and Trademarks*